US010048635B2

(12) United States Patent
Kenmotsu

(10) Patent No.: US 10,048,635 B2
(45) Date of Patent: Aug. 14, 2018

(54) SHEET POST-PROCESSING APPARATUS AND IMAGE FORMING SYSTEM

(71) Applicants: KABUSHIKI KAISHA TOSHIBA, Tokyo (JP); TOSHIBA TEC KABUSHIKI KAISHA, Tokyo (JP)

(72) Inventor: Takahide Kenmotsu, Fuji Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 51 days.

(21) Appl. No.: 15/392,309

(22) Filed: Dec. 28, 2016

(65) Prior Publication Data

US 2018/0181048 A1 Jun. 28, 2018

(51) Int. Cl.
*G03G 15/00* (2006.01)

(52) U.S. Cl.
CPC ..... *G03G 15/6538* (2013.01)

(58) Field of Classification Search
CPC ..... G03G 15/6529; G03G 15/6538; G03G 15/6544; B65H 29/20; B65H 37/04; B65H 2801/27; B65H 2301/51611
See application file for complete search history.

(56) References Cited

U.S. PATENT DOCUMENTS

| | | | | |
|---|---|---|---|---|
| 7,192,020 | B2 * | 3/2007 | Hayashi | B42C 1/12 270/58.01 |
| 7,354,036 | B2 * | 4/2008 | Hayashi | B42C 1/12 270/58.01 |
| 7,552,917 | B2 * | 6/2009 | Hayashi | B42C 1/12 270/58.01 |
| 8,585,044 | B2 * | 11/2013 | Matsui | G03G 15/6552 271/176 |
| 2008/0124120 | A1 * | 5/2008 | Kang | G03G 15/167 399/121 |
| 2009/0065998 | A1 * | 3/2009 | Iguchi | B65H 31/3081 270/1.01 |
| 2014/0291922 | A1 | 10/2014 | Yamamoto | |
| 2015/0165809 | A1 * | 6/2015 | Komiyama | B42B 5/08 412/38 |
| 2015/0183610 | A1 * | 7/2015 | Matsuki | B65H 37/04 270/58.08 |
| 2015/0310316 | A1 * | 10/2015 | Osada | G06K 15/16 358/1.12 |

* cited by examiner

*Primary Examiner* — David Banh
(74) *Attorney, Agent, or Firm* — Patterson & Sheridan, LLP

(57) ABSTRACT

A sheet processing apparatus according to an embodiment includes a first holding unit configured to hold one or more sheets and movable in a sheet transport direction, a drive unit configured to move the first holding unit in the sheet transport direction, a biasing member, and a conversion unit. The biasing member biases the first holding unit in a second direction opposite to the sheet transport direction, stores elastic energy when the first holding unit is moved in the sheet transport direction, and moves the first holding unit in the second direction when the stored elastic energy in the biasing member is released. The conversion unit has a shaft configured to be rotated by the elastic energy stored in the biasing member to generate electrical energy.

20 Claims, 6 Drawing Sheets

SHEET POST-PROCESSING APPARATUS AND IMAGE FORMING SYSTEM

FIELD

Embodiments described herein relate generally to a sheet post-processing apparatus and an image forming system.

BACKGROUND

Generally, some image forming systems include a sheet post-processing apparatus that performs post-processing on sheets. For example, the sheet post-processing apparatus supports a plurality of sheets stacked on a processing tray. An ejector is disposed on an upstream side of the processing tray in a sheet transport direction. The ejector supports the plurality of sheets on the processing tray. The ejector is fixed to an ejector belt. The ejector belt is rotated by a stepping motor or the like. When the ejector belt rotates, the ejector moves the plurality of sheets to a downstream side of the processing side.

In order to move the plurality of sheets to the downstream side, a bundle hook is used together with the ejector. The bundle hook is fixed to a bundle hook belt. When the bundle hook belt rotates, the sheets supported by the ejector are delivered to the bundle hook. The bundle hook transports the sheets downstream of the processing tray.

In order to return the ejector from the downstream side to an original position on the upstream side, a winding spring is used. By a stepping motor, the ejector belt rotates and the winding spring is extended. When the winding spring is extended, elastic energy is stored in the winding spring. When interlocking of the stepping motor and the winding spring is released, the winding spring returns the ejector to the original position. That is, the elastic energy stored in the winding spring is used for returning the ejector to the original position.

DETAILED DESCRIPTION

A sheet processing apparatus according to an embodiment includes a first holding unit configured to hold one or more sheets and movable in a sheet transport direction, a drive unit configured to move the first holding unit in the sheet transport direction, a biasing member, and a conversion unit. The biasing member biases the first holding unit in a second direction opposite to the sheet transport direction, stores elastic energy when the first holding unit is moved in the sheet transport direction, and moves the first holding unit in the second direction when the stored elastic energy in the biasing member is released. The conversion unit has a shaft configured to be rotated by the elastic energy stored in the biasing member to generate electrical energy. Hereinafter, the sheet post-processing apparatus and an image forming system according to the embodiment will be described with reference to the drawings.

Figure 1:
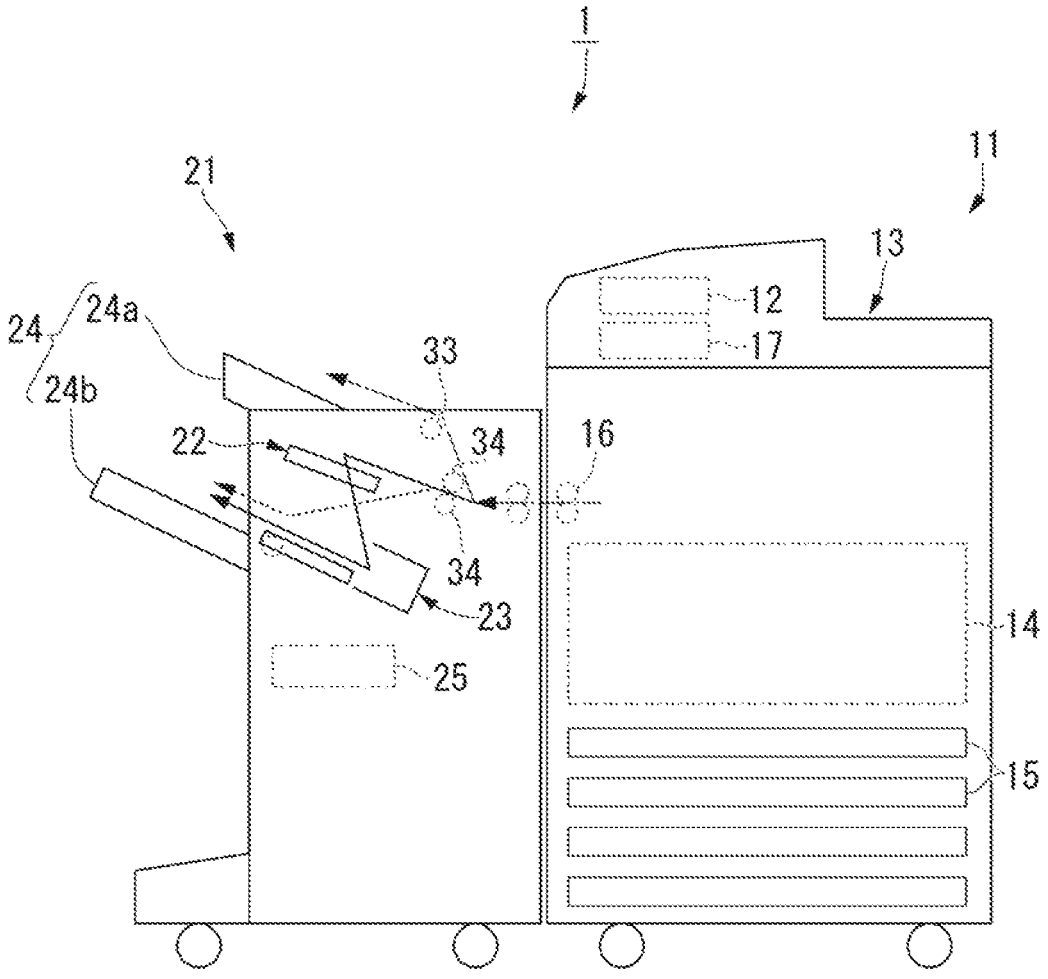
FIG. 1 is a front view schematically illustrating an example configuration of an image forming system according to an embodiment.
Figure 2:
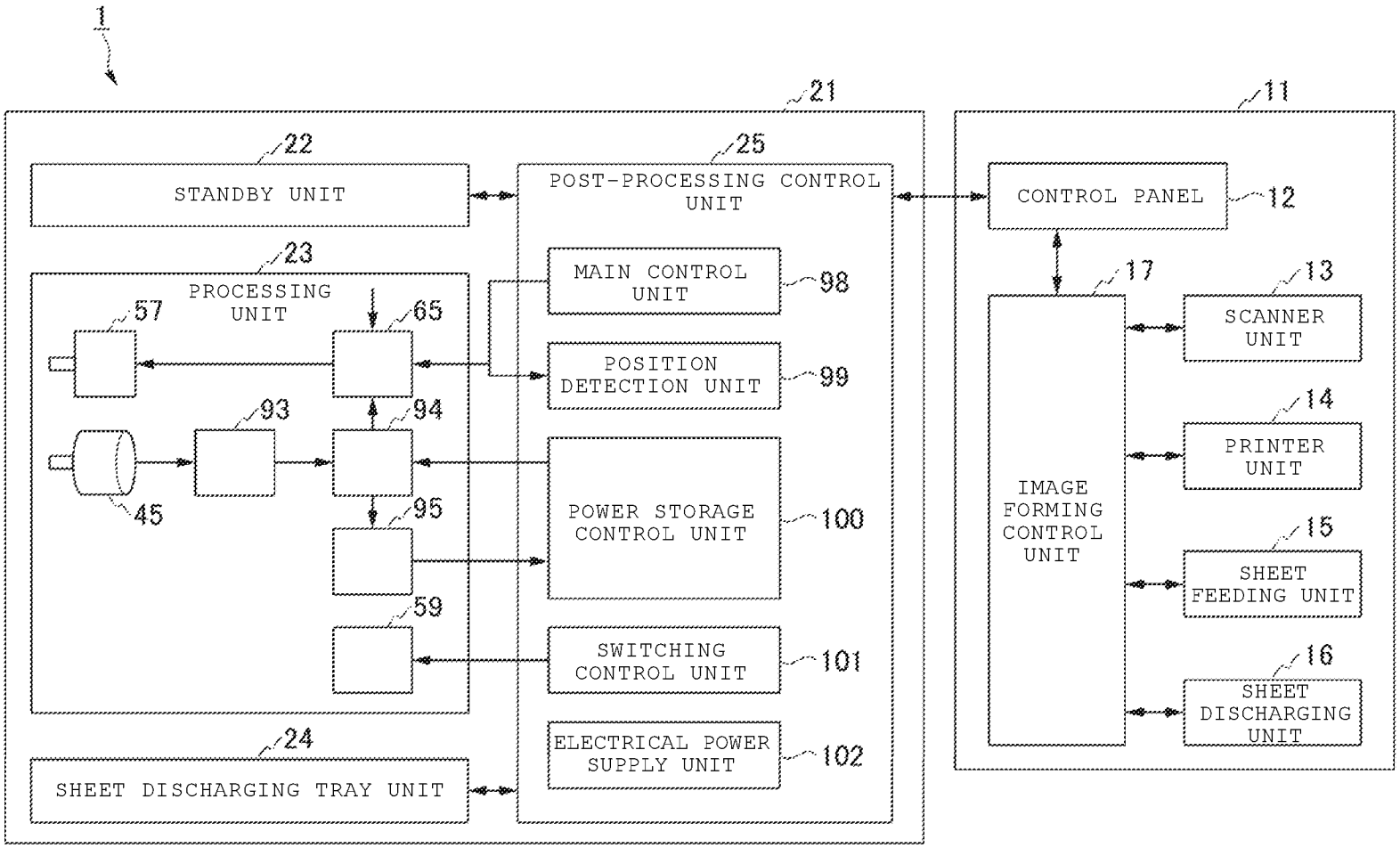
FIG. 2 is a block diagram of the image forming system.

As illustrated in FIG. 1 and FIG. 2, an image forming system 1 includes an image forming apparatus 11 and a sheet post-processing apparatus 21.

The image forming apparatus 11 forms an image on a sheet. More particularly, the image forming apparatus 11 includes a control panel 12, a scanner unit 13, a printer unit 14, a sheet feeding unit 15, a sheet discharging unit 16, and an image forming control unit 17.

The control panel 12 includes various keys or touch panel icons for receiving inputs of a user. The control panel 12 sends information or the like relating to the discharge destination of the sheet to the sheet post-processing apparatus 21. The scanner unit 13 includes a reading unit for generating image data corresponding to a copied object. The scanner unit 13 sends the image data to the printer unit 14.

The printer unit 14 forms an output image (hereinafter, referred to as "toner image") using a developer such as toner and the like. The toner image is formed based on the image data transmitted from the scanner unit 13 or from an external device.

The sheet feeding unit 15 supplies sheets to the printer unit 14 one by one, in accordance with a time during which the printer unit 14 is ready to form a toner image on a sheet.

The sheet discharging unit 16 transports sheets discharged from the printer unit 14 to the sheet post-processing apparatus 21.

The image forming control unit 17 controls the entirety of operations of the image forming apparatus 11. That is, the image forming control unit 17 controls the control panel 12, the scanner unit 13, the printer unit 14, the sheet feeding unit 15, and the sheet discharging unit 16. For example, the image forming control unit 17 is configured with a control circuit including a central processing unit (CPU), a random access memory (RAM), and the like.

Next, the sheet post-processing apparatus 21 will be described.

The sheet post-processing apparatus 21 is arranged in the vicinity of the image forming apparatus 11. The sheet post-processing apparatus 21 performs processing on the sheets transported from the image forming apparatus 11 based on instructions input through the control panel 12. The sheet post-processing apparatus 21 includes a standby unit 22, a processing unit 23, a sheet discharging tray unit 24, and a post-processing control unit 25.

The standby unit 22 temporarily holds the sheets transported from the image forming apparatus 11. For example, the standby unit 22 holds a subsequently processed plurality of sheets, while post-processing on previously processed sheets is performed in the processing unit 23. The standby unit 22 drops the sheets it held into the processing unit 23 when the processing unit 23 is free.

The processing unit 23 performs the post-processing on the sheets. The post-processing includes processes such as a sorting process, a stapling process, or the like. For example, the processing unit 23 aligns the plurality of sheets. The processing unit 23 then performs stapling on the aligned plurality of sheets. The processing unit 23 then discharges the sheets on which the post-processing is performed to the sheet discharging tray unit 24.

The sheet discharging tray unit 24 includes a fixed tray 24*a* and a movable tray 24*b*. The fixed tray 24*a* is provided on an upper portion of the sheet post-processing apparatus 21. Meanwhile, the movable tray 24*b* is provided on a side portion of the sheet post-processing apparatus 21. The movable tray 24*b* can be moved in a vertical direction along the side portion of the sheet post-processing apparatus 21. A sheet is discharged to either the fixed tray 24*a* or the movable tray 24*b* according to the discharge destination of a sheet selected through the control panel 12.

Next, a configuration of each unit of the sheet post-processing apparatus 21 will be described in detail.

In the following description, the "upstream side" and the "downstream side" refer to a transportation direction of a sheet S illustrated in FIG. 3, respectively.

Figure 3:
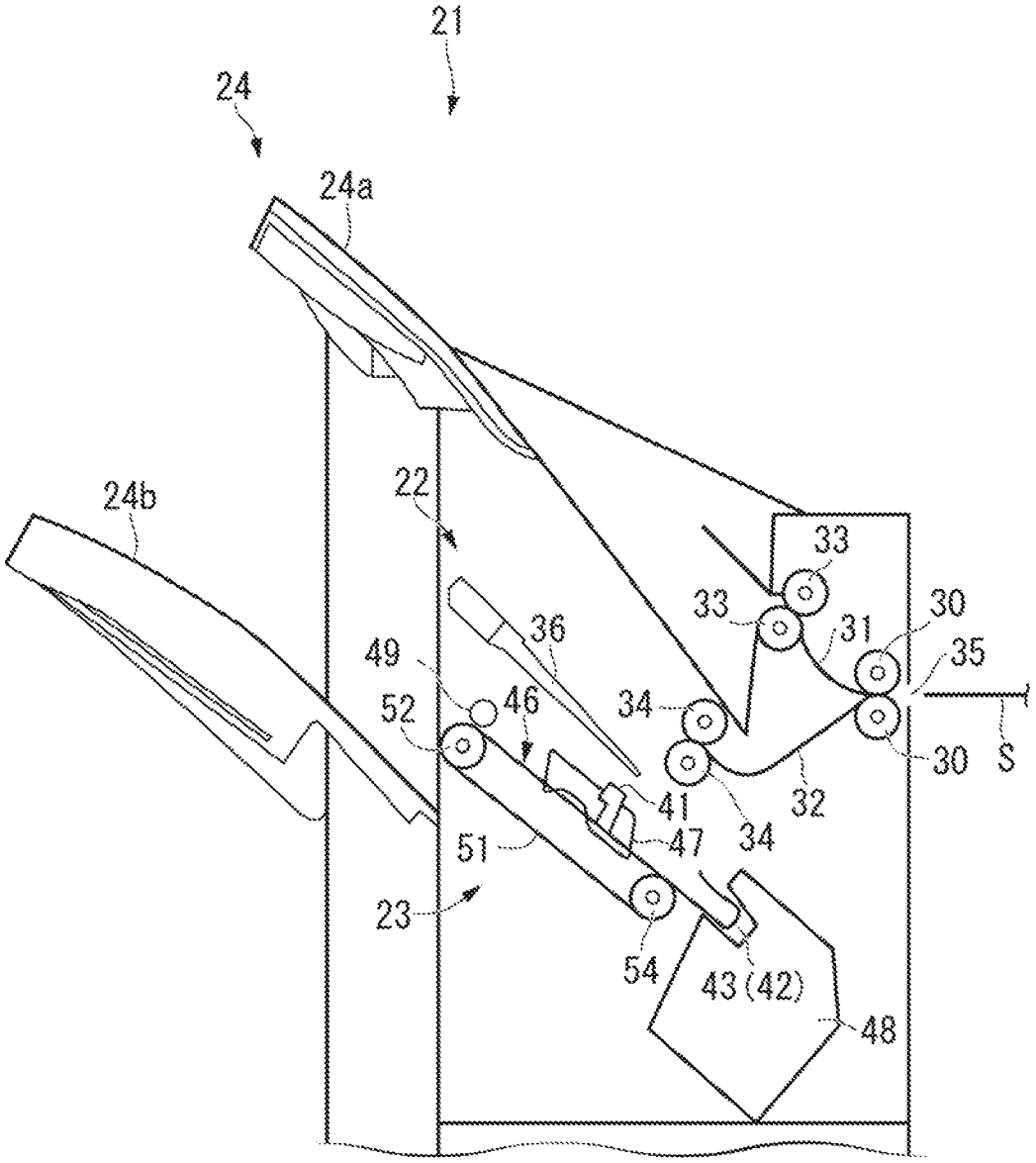
FIG. 3 is a sectional view schematically illustrating a sheet post-processing apparatus according to the embodiment.

As illustrated in FIG. 3, the sheet post-processing apparatus 21 includes an inlet roller 30, a first transportation path 31, a second transportation path 32, a discharge roller 33, and an outlet roller 34.

The inlet roller 30 is provided near a sheet supply port 35 of the sheet post-processing apparatus 21. The inlet roller 30 transports the sheet S supplied to the sheet supply port 35. The inlet roller 30 transports the sheet S toward an inside of the sheet post-processing apparatus 21.

The first transportation path 31 is provided between the inlet roller 30 and the fixed tray 24*a* of the sheet discharging tray unit 24. The discharge roller 33 is positioned at an end of the downstream side of the first transportation path 31. The discharge roller 33 discharges the sheet S transported through the first transportation path 31 toward the fixed tray 24*a*.

The second transportation path 32 is provided between the inlet roller 30 and the outlet roller 34. The outlet roller 34 is provided in an end portion of the downstream side of the second transportation path 32. For example, the outlet roller 34 transports the sheet S transported through the second transportation path 32 toward the standby unit 22.

The standby unit 22 includes a standby tray 36 and an opening and closing drive unit (not illustrated). The standby tray 36 has two separate portions arranged side-by-side in parallel with a width direction of the sheet S intersecting the transportation direction of the sheet S. An end portion of the upstream side of each portion of the standby tray 36 is positioned slightly below an outlet of the second transportation path 32. The sheet S is transported from the second transportation path 32 to the standby tray 36. The standby tray 36 holds a stack of the plurality of sheets S, while the post-processing is performed on other sheets S in the processing unit 23. A processing tray 46 to be described below of the processing unit 23 is disposed below the standby tray 36.

The opening and closing drive unit can move the portions of the standby tray 36 in the width direction. When the portions of the standby tray 36 are moved together in the width direction, the sheets S are supported on the standby tray 36. When the portions of the standby tray 36 are separated from each other in the width direction, the sheets S supported on the standby tray 36 are moved to the processing tray 46.

Figure 4:
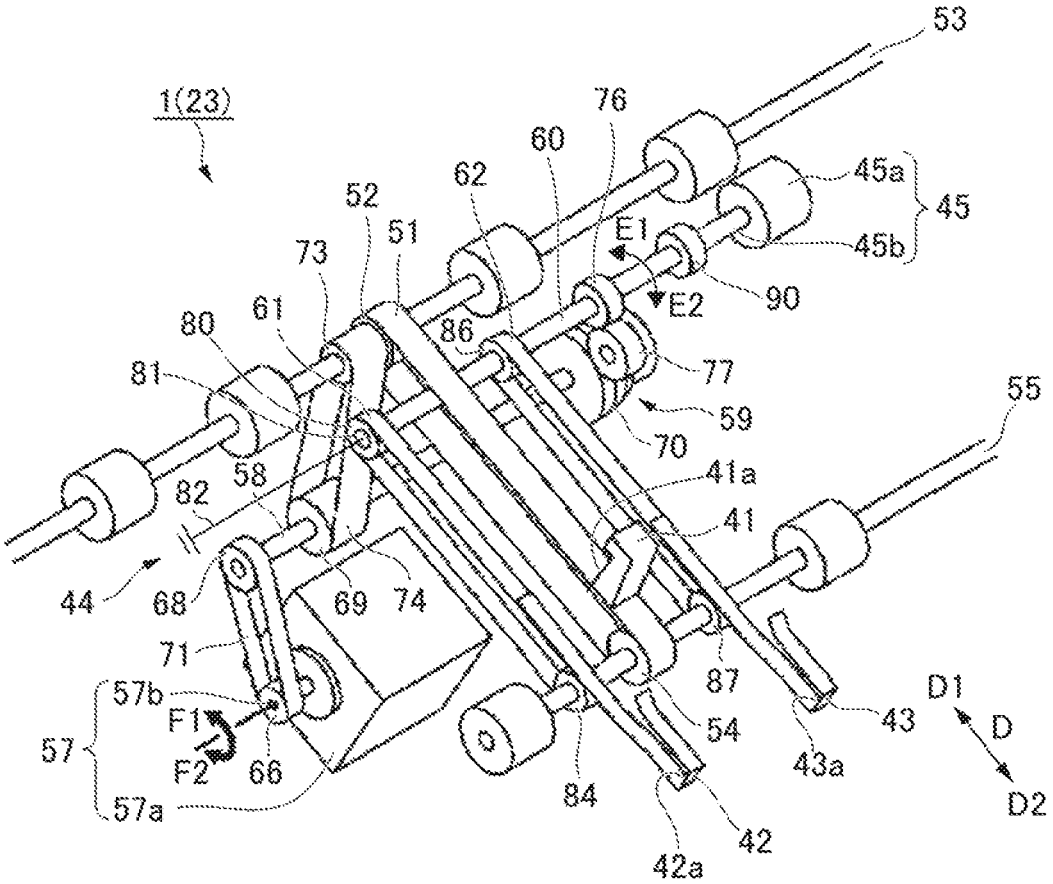
FIG. 4 is a perspective view schematically illustrating a main part of a sheet post-processing unit according to the embodiment.

As illustrated in FIG. 3 and FIG. 4, the processing unit 23 includes a bundle hook 41, a pair of ejectors (first holding unit) 42 and 43, a drive unit 44, a DC motor (conversion unit) 45, the processing tray 46, a pair of lateral alignment plates (one lateral alignment plate 47 is not illustrated), a stapler 48, and a discharge roller 49.

For convenience of description, the processing tray 46 or the like is not illustrated in FIG. 4.

For example, a concave portion 41*a* for holding the plurality of sheets S is formed in the bundle hook 41. The bundle hook 41 is fixed to a bundle hook belt 51. The bundle hook belt 51 is a continuous belt maintained in an annular shape in which a transportation direction D of the sheet S is the major axis. The bundle hook 41 is fixed to an outer periphery surface of the bundle hook belt 51.

An end of the bundle hook belt 51 in the first direction D1 (which is the downstream side) is wound around a roller 52. The roller 52 can rotate around a first support shaft 53. An end of the bundle hook belt 51 in a second direction D2 (which is the upstream side) is wound around a roller 54. The roller 54 can rotate around a second support shaft 55. The first direction D1 and the second direction D2 are directions parallel to the transportation direction D. The second direction D2 is a direction opposite to the first direction D1.

The support shafts 53 and 55, a third support shaft 58, and a fourth support shaft 60 (described below) extend in the width direction orthogonal to the transportation direction D. The support shafts 53, 55, 58, and 60 are supported by a frame (not illustrated) or the like of the sheet post-processing apparatus 21.

The ejectors 42 and 43 are arranged on opposite sides the bundle hook 41 in the width direction. Concave portions 42*a* and 43*a* for holding the plurality of sheets S are formed on each of the ejectors 42 and 43.

The drive unit 44 includes a drive motor (power generating unit) 57, the third support shaft 58, a clutch mechanism (first switching unit) 59, the fourth support shaft 60, and ejector belts 61 and 62.

In the embodiment, the drive motor 57 is a stepping motor. For example, when a pulse signal generated from a motor controller 65 (see FIG. 2) is input to the drive motor 57, the drive motor 57 is driven. The motor controller 65 and the drive motor 57 are driven by electricity.

The drive motor 57 includes a motor main body 57*a* and a drive shaft 57*b* which rotates relative to the motor main body 57*a*. The motor main body 57*a* is fixed to a frame or the like of the sheet post-processing apparatus 21. When the drive motor 57 is driven, the drive shaft 57*b* rotates. The drive motor 57 can rotate the drive shaft 57*b* in a desired direction such as a direction F1 and a direction F2 around an axis.

A roller 66 is fixed to the drive shaft 57*b*.

A pulse signal generated from the motor controller 65 is also sent not only to the drive motor 57, but also to the post-processing control unit 25.

Rollers 68, 69, and 70 are fixed to the third support shaft 58. A drive belt 71 is wound around the roller 66 of the drive motor 57 and the roller 68 of the third support shaft 58. The first support shaft 53 supports a roller 73. The roller 73 can rotate around the first support shaft 53. The roller 73 is fixed to the roller 52. The rollers 52 and 73 integrally rotate around the first support shaft 53. A drive belt 74 is wound around the roller 69 of the third support shaft 58 and the roller 73 of the first support shaft 53.

A clutch mechanism 59 includes a roller 76 fixed to the fourth support shaft 60, the above-mentioned roller 70, a switching roller 77, and a movement mechanism (not illustrated). The movement mechanism has a known configuration, and causes the switching roller 77 to come into contact with the rollers 70 and 76, or to separate the switching roller 77 from the rollers 70 and 76.

The movement mechanism causes the switching roller 77 to come into contact with the rollers 70 and 76. By interlocking with rotation of the roller 70, the switching roller 77 and the roller 76 rotate. As described below, the clutch mechanism 59 causes the drive motor 57 and the ejectors 42 and 43 to interlock with each other in an engaged state.

Further, the movement mechanism separates the switching roller 77 from the rollers 70 and 76. By interlocking with the rotation of the roller 70, the roller 76 does not rotate. As described below, the clutch mechanism 59 causes the interlocking of the drive motor 57 and the ejectors 42 and 43 to be released in a released state.

The clutch mechanism 59 is selectively switched between one of the engaged state and the released state.

The ejector belts 61 and 62 are circularly formed and rotate in the transportation direction D. An end in the first direction D1 of the ejector belt 61 is wound around a roller 80. The roller 80 is fixed to the fourth support shaft 60.

A winding spring (biasing member) 81 is positioned between the fourth support shaft 60 and the roller 80. A first end of the winding spring 81 is fixed to a frame or the like of the sheet post-processing apparatus 21 by a connection member 82. A second end of the winding spring 81 is fixed to the roller 80.

An end in the second direction D2 of the ejector belt 61 is wound around a roller 84. The roller 84 can rotate around the second support shaft 55. An ejector 42 is fixed on an upper, outer periphery surface of the ejector belt 61. An end in the first direction D1 of the ejector belt 62 is wound around a roller 86. The roller 86 is fixed to the fourth support shaft 60. An end in the second direction D2 of the ejector belt 62 is wound around a roller 87. The roller 87 can rotate around the second support shaft 55. The ejector 43 is fixed on an upper, outer periphery surface of the ejector belt 62.

The ejectors 42 and 43 and the winding spring 81 configured in this manner are operated as follows.

As described below, the drive unit 44 integrally rotates the fourth support shaft 60 and the rollers 80 and 86 in a direction E1 around the fourth support shaft 60. The ejectors 42 and 43 are moved in the first direction D1 along with the ejector belts 61 and 62. The winding spring 81 is wound tight, and elastic energy is stored in the winding spring 81. The drive unit 44 moves the ejectors 42 and 43 in the first direction D1. When the clutch mechanism 59 is switched to the released state, the elastic energy stored in the winding spring 81 is released. The fourth support shaft 60 rotates in a direction E2. The ejectors 42 and 43 are moved in the second direction D2. The energy from the winding spring 81 biases the ejectors 42 and 43 in the second direction D2, causing the ejectors 42 and 43 to move in the second direction when the clutch mechanism 59 is switched to the released state.

The ejectors 42 and 43 are moved within a predetermined range in the transportation direction D on the upper surface of the ejector belts 61 and 62. A standby position of the ejectors 42 and 43 is at an end in a movement range of the ejectors 42 and 43 in the second direction D2.

The DC motor 45 includes a motor main body 45*a* and a rotation shaft 45*b* which rotates around an axis with respect to the motor main body 45*a*. The motor main body 45*a* is fixed to a frame or the like of the sheet post-processing apparatus 21. The rotation shaft 45*b* is connected to the fourth support shaft 60 through a one-way clutch (second switching unit) 90. The rotation shaft 45*b* is disposed on the same axis as the fourth support shaft 60.

The one-way clutch 90 causes the fourth support shaft 60 and the rotation shaft 45*b* of the DC motor 45 to be disengaged with each other when the fourth support shaft 60 rotates in the direction E1. The one-way clutch 90 causes the ejectors 42 and 43 and the DC motor 45 to be disengaged with each other when the ejectors 42 and 43 are moved in the first direction D1. Meanwhile, the one-way clutch 90 causes the fourth support shaft 60 and the rotation shaft 45*b* to be engaged with each other when the fourth support shaft 60 rotates to the direction E2. The one-way clutch 90 causes the ejectors 42 and 43 and the DC motor 45 to be engaged with each other, when the ejectors 42 and 43 are moved to the second direction D2.

The rotation shaft 45*b* of the DC motor 45 rotates when the ejectors 42 and 43 move in to the second direction D2. The DC motor 45 generates power when the rotation shaft 45*b* rotates such that the electrical energy is generated. The rotation shaft 45*b* of the DC motor 45 rotates with the rotation of the fourth support shaft 60 in the direction E2.

The DC motor 45 converts the elastic energy released from the winding spring 81 into a DC voltage, i.e., electrical energy. As illustrated in FIG. 2, the DC motor 45 sends the converted DC voltage to a constant voltage circuit 93 so as to make a constant voltage. The constant voltage circuit 93 sends the DC voltage to a power storage unit 94 such as a lithium ion secondary battery and the like. The power storage unit 94 stores the DC voltage as electrical energy. The power storage unit 94 supplies the stored electrical energy to the motor controller 65, based on a power storage control unit 100 described below.

An electrical power detection unit (detection unit) 95 is connected to the power storage unit 94. The electrical power detection unit 95 detects the electrical energy stored in the power storage unit 94. For example, the electrical power detection unit 95 detects a potential difference between both electrodes of the power storage unit 94. The electrical power detection unit 95 sends a detection result to the power storage control unit 100 described below of the post-processing control unit 25.

As illustrated in FIG. 3, the processing tray 46 is inclined with respect to a horizontal direction so that the downstream side is higher.

The pair of lateral alignment plates 47 is provided on an upper surface of the processing tray 46. The pair of lateral alignment plates 47 is provided to align the plurality of sheets S supported on the processing tray 46 in the width direction. For example, the pair of lateral alignment plates 47 is moved by an aligning plate movement mechanism including a motor, a pinion gear, a rack, and the like. The pair of lateral alignment plates 47 can align the plurality of sheets S by moving towards each other in the width direction, as controlled by the aligning plate movement mechanism. The pair of lateral alignment plates 47 can be retracted from the plurality of sheets S by moving away from each other in the width direction.

The stapler 48 performs stapling (binding) on a bundle of the plurality of sheets S supported on the processing tray 46. The discharge roller 49 is provided in an end of the downstream side of the processing tray 46. The discharge roller 49 discharges the plurality of sheets S supported on the processing tray 46 toward the movable tray 24*b* of the sheet discharging tray unit 24.

As illustrated in FIG. 3, the post-processing control unit 25 includes a main control unit 98, a position detection unit 99, the power storage control unit 100, a switching control unit 101, and an electrical power supply unit 102.

For example, the main control unit 98, the position detection unit 99, the power storage control unit 100, and the switching control unit 101 are configured similar to the above-described image forming control unit 17.

The position detection unit 99 detects positions of the ejectors 42 and 43 and the bundle hook 41. The position detection unit 99 includes a counter that counts the number of pulses. The ejectors 42 and 43 are moved from a standby position in the first direction D1 in response to a pulse signal from the motor controller 65. There is a certain relationship between the number of pulses of the pulse signal and positions of the ejectors 42 and 43. The position detection unit 99 detects the positions of the ejectors 42 and 43 by counting the number of pulses of the pulse signal. For example, when it is detected that the ejectors 42 and 43 are at a reference position P1 (see FIG. 6) which is an end in the first direction D1 of the movement range of the ejectors 42 and 43, the position detection unit 99 sends a detection result to the switching control unit 101.

By the same method, the position detection unit 99 detects a position of the bundle hook 41.

The power storage control unit 100 controls the power storage unit 94 based on a detection result of the electrical power detection unit 95. The power storage control unit 100 stores a predetermined reference electrical power. The power storage control unit 100 supplies the electrical energy stored in the power storage unit 94 to the motor controller 65 of the drive unit 44 when the electrical power detected by the electrical power detection unit 95 is equal to or greater than the reference electrical power. Further, the power storage control unit 100 does not supply the electrical energy stored in the power storage unit 94 to the motor controller 65 when the electrical power detected by the electrical power detection unit 95 is less than the reference electrical power.

The switching control unit 101 controls the clutch mechanism 59. When the clutch mechanism 59 is in the engaged state, the switching control unit 101 switches the clutch mechanism 59 to the released state so that the ejectors 42 and 43 are moved to the reference position P1 by being moved in the first direction D1.

The main control unit 98 performs overall control relating to the sheet post-processing apparatus 21, other than control performed by the power storage control unit 100 and the switching control unit 101.

The electrical power supply unit 102 converts AC voltage supplied to the sheet post-processing apparatus 21 into DC voltage, and supplies the converted DC voltage to the motor controller 65 or the like.

Figure 5:
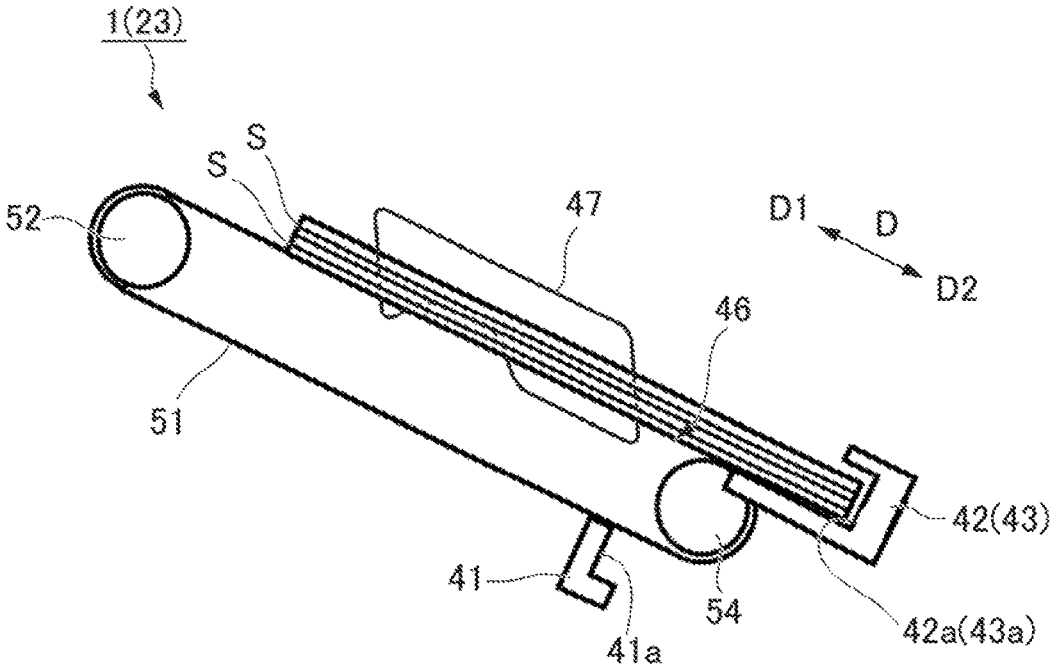
FIGS. 5-7 are sectional views schematically illustrating operation of a hook and an ejector in the image forming system according to the embodiment.

Next, an operation of the image forming system 1 configured as described above will be described based on an operation of the processing unit 23 of the sheet post-processing apparatus 21. In advance, certain initial conditions are assumed. Specifically, the ejectors 42 and 43 are at the standby position, as illustrated in FIG. 5. By rotation of the bundle hook belt 51, the bundle hook 41 is at a standby position on a downward surface of the bundle hook belt 51. The clutch mechanism 59 is in the engaged state. The lateral alignment plates 47 (which are a pair) are separated from each other in the width direction. The electrical power is not stored in the power storage unit 94.

A user starts the image forming system 1 by operating the control panel 12. For example, a user selects the movable tray 24*b* as a discharge destination of the sheet S by operating the control panel 12. In the sheet post-processing apparatus 21, the DC voltage is supplied from the electrical power supply unit 102 to the motor controller 65. The electrical power detection unit 95 detects the electrical power of the electrical energy stored in the power storage unit 94 at certain time intervals. The electrical power detection unit 95 sends a detection result to the power storage control unit 100 of the post-processing control unit 25. The image forming apparatus 11 transports the sheet S on which a toner image is formed from the sheet supply port 35 toward an inside of the sheet post-processing apparatus 21.

The sheet post-processing apparatus 21 transports the sheet S through the second transportation path 32. Multiple sheets S are supported on the pair of standby trays 36. As illustrated in FIG. 5, the sheets S are transported to the processing tray 46. The sheets S are held in the concave portions 42*a* and 43*a* of the ejectors 42 and 43, respectively. The main control unit 98 causes the lateral alignment plates 47 to approach each other, by driving the aligning plate movement mechanism, and align the sheets S. The stapler 48 is driven so that the stapling is appropriately performed.

Figure 6:
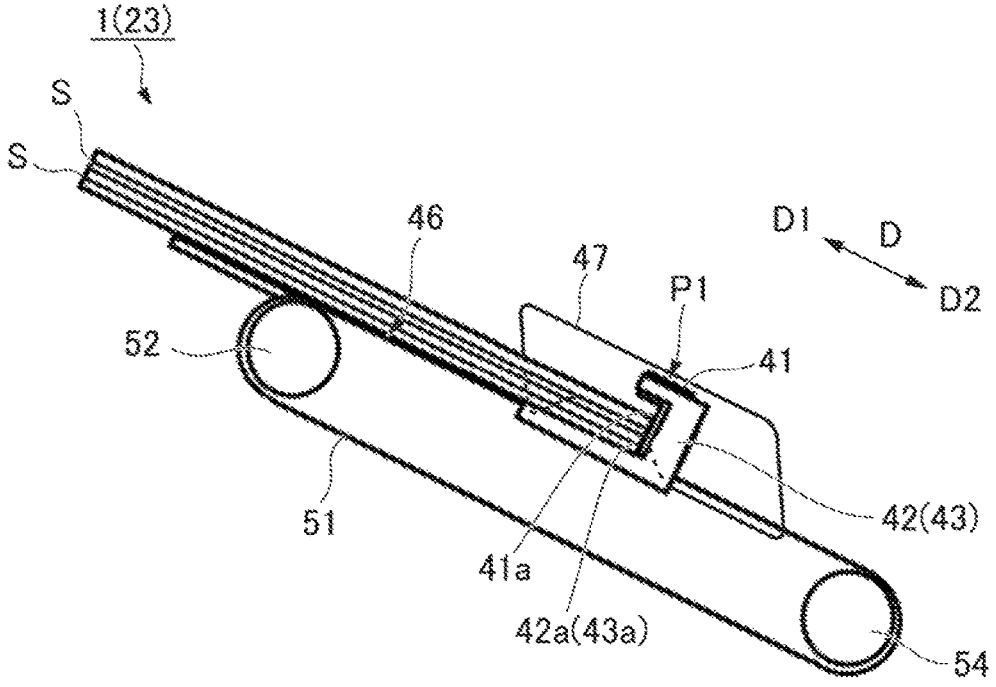

The main control unit 98 rotates the drive shaft 57*b* of the drive motor 57 in the direction F1 (see FIG. 4), by driving the motor controller 65 (feeding process S1 of ejector and bundle hook). As the drive shaft 57*b* rotates, the drive belt 71, the third support shaft 58, the drive belt 74, and the rollers 52 and 73 are also caused to rotate. Since the clutch mechanism 59 is in the engaged state, the fourth support shaft 60 rotates in the direction E1 due to the rotation of the third support shaft 58. By rotating the ejector belts 61 and 62, the ejectors 42 and 43 are moved in the first direction D1, as illustrated in FIG. 6. The winding spring 81 is wound tight. The plurality of sheets S are moved in the first direction D1, while being guided by the pair of lateral alignment plates 47. When the clutch mechanism 59 is in the engaged state, the drive motor 57 causes the ejectors 42 and 43 to move.

When the fourth support shaft 60 rotates to the direction E1, the one-way clutch 90 causes the fourth support shaft 60 and the rotation shaft 45*b* of the DC motor 45 to not be engaged with each other. When the fourth support shaft 60 rotates in the direction E1, the DC motor 45 does not convert energy. Meanwhile, as the roller 52 rotates, the bundle hook belt 51 and the bundle hook 41 are caused to rotate. The bundle hook 41 moves in the second direction D2 towards a lower surface of the bundle hook belt 51, and moves in the first direction D1 towards an upper surface of the bundle hook belt 51.

In this manner, driving force of the drive motor 57 in the direction F1 is transmitted, in order, to the drive belt 71, the third support shaft 58, the clutch mechanism 59, the fourth support shaft 60, and the ejector belts 61 and 62. The ejectors 42 and 43 are thus moved in the first direction D1. The driving force of the drive motor 57 in the direction F2 is transmitted, in order, to the drive belt 71, the third support shaft 58, the drive belt 74, and the bundle hook belt 51. The bundle hook 41 moves with the rotation of the bundle hook belt 51. The drive motor 57 generates driving force for moving the ejectors 42 and 43 in the first direction D1. The support shafts 58 and 60 rotate and move the ejectors 42 and 43.

Movement speed of the bundle hook 41 is faster than movement speed of the ejectors 42 and 43. As illustrated in FIG. 6, the bundle hook 41 receives the plurality of sheets S from the ejectors 42 and 43. The sheets S are held in the concave portion 41*a* of the bundle hook 41. For example, positions of the ejectors 42 and 43 when receiving the plurality of sheets S by the bundle hook 41 are the above-described reference position P1.

In the feeding process S1 of the ejector and the bundle hook, the main control unit 98 moves the ejectors 42 and 43 and the bundle hook 41 in the first direction D1 towards the upper surface of the ejector belts 61 and 62.

When it is detected that the ejectors 42 and 43 are at the reference position P1, the position detection unit 99 sends a detection result to the switching control unit 101 (returning process S3). The switching control unit 101 switches the clutch mechanism 59 from the engaged state to the released state. In the released state, even though the third support shaft 58 rotates, the driving force transmitted to the third support shaft 58 is not transmitted to the fourth support shaft 60.

When the clutch mechanism is in the released state, the winding spring 81 discharges the stored elastic energy. The fourth support shaft 60 rotates in the direction E2, and the ejectors 42 and 43 are moved in the second direction D2. When the clutch mechanism 59 is in the released state, the drive motor 57 is not engaged with the ejectors 42 and 43. By setting the clutch mechanism 59 to the released state, the driving force of the drive motor 57 is not an obstacle with respect to the movement of the ejectors 42 and 43 in the second direction D2. The ejectors 42 and 43 are thereby moved to the second direction D2 due to the energy of the winding spring 81.

Figure 7:
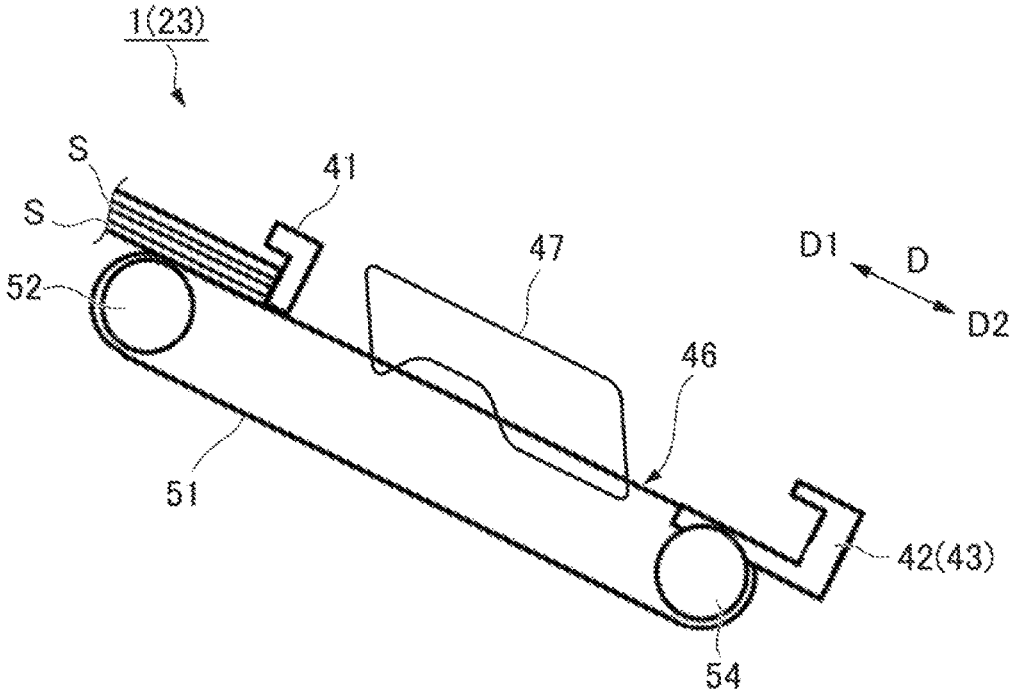

The one-way clutch 90 causes the fourth support shaft 60 and the rotation shaft 45*b* of the DC motor 45 to be engaged with each other when the fourth support shaft 60 rotates in the direction E2. The DC motor 45 converts the elastic energy discharged from the winding spring 81 into DC voltage. After the DC voltage is converted into a constant voltage in the constant voltage circuit 93, the converted voltage is stored in the power storage unit 94. As illustrated in FIG. 7, the ejectors 42 and 43 return to the standby position.

Further, after the clutch mechanism 59 is switched to the released state, the bundle hook 41 moves in the first direction D1 towards the upper surface of the bundle hook belt 51. The bundle hook 41 reaches an end of the upper surface of the bundle hook belt 51 in the first direction D1. The bundle hook 41 pushes the plurality of sheets S from the processing tray 46 in the first direction D1. The discharge roller 49 discharges the pushed plurality of sheets S to the movable tray 24*b*.

In the returning process S3 of the ejector, the main control unit 98 moves the ejectors 42 and 43 in the second direction D2 of the ejector belts 61 and 62 to the standby position.

When it is detected that the bundle hook 41 is at an end in the first direction D1, the position detection unit 99 sends a detection result to the switching control unit 101 (returning process S5). The main control unit 98 rotates the drive shaft 57*b* of the drive motor 57 in the direction F2 (see FIG. 4) by driving the motor controller 65. Rotation of the drive shaft 57*b* causes the drive belt 71, the third support shaft 58, the drive belt 74, and the bundle hook belt 51 to rotate. The bundle hook 41 moves in the second direction D2 on the upper surface of the bundle hook belt 51. The bundle hook 41 is moved in the first direction D1 towards the lower surface of the bundle hook belt 51. The bundle hook 41 returns to the standby position. The main control unit 98 separates the lateral alignment plates 47 from each other by driving the aligning plate movement mechanism.

In the returning process S5, the main control unit 98 moves the bundle hook 41 in the second direction D2 from the upper surface of the bundle hook belt 51 to the standby position.

The post-processing control unit 25 combines and repeats the feeding process S1 of the ejector and the bundle hook, the returning process S3 of the ejector, and the returning process S5 of the bundle hook, as described above. The power storage control unit 100 supplies the electrical energy stored in the power storage unit 94 to the motor controller 65 of the drive unit 44, when the electrical power detected by the electrical power detection unit 95 is equal to or greater than the reference electrical power. The motor controller 65 drives the drive motor 57 by using the electrical energy stored in the power storage unit 94.

As described above, the sheet post-processing apparatus 21 according to the embodiment includes the DC motor 45. When the ejectors 42 and 43 are moved in the second direction D2 by the winding spring 81, the DC motor 45 converts elastic energy released from the winding spring 81 into electrical energy. Accordingly, it is possible to efficiently use the elastic energy stored in the winding spring 81 without waste.

The sheet post-processing apparatus 21 includes the power storage unit 94. The power storage unit 94 can store the electrical energy converted by the DC motor 45.

The power storage unit 94 supplies the stored electrical energy to the drive unit 44. The sheet post-processing apparatus 21 can use the electrical energy stored in the power storage unit 94 in the drive unit 44 without waste.

The sheet post-processing apparatus 21 includes the electrical power detection unit 95 and the power storage control unit 100. When the electrical power detected in the electrical power detection unit 95 is equal to or greater than a predetermined reference electrical power, the electrical power is supplied to the drive unit 44. Even when the electrical power converted through one returning process S3 of the ejector is small, it is possible to collectively supply electrical power converted through multiple times of returning process S3 of the ejector to the drive unit 44.

The drive unit 44 includes the drive motor 57 and the clutch mechanism 59. When the ejectors 42 and 43 are moved in the second direction D2, the clutch mechanism 59 is in the released state. Thus, the driving force of the drive motor 57 is not an obstacle with respect to the movement of the ejectors 42 and 43 to the second direction D2.

When the ejectors 42 and 43 are at the reference position P1 by being moved in the first direction D1, the switching control unit 101 switches the clutch mechanism 59 to be in the released state. When the ejectors 42 and 43 are at the reference position P1, extension of the winding spring 81 becomes constant. It is possible to stabilize the magnitude of the elastic energy stored in the winding spring 81 and further converted by the DC motor 45.

The sheet post-processing apparatus 21 includes the one-way clutch 90. Only when the ejectors 42 and 43 are moved in the second direction D2, it is possible to convert the elastic energy to the electrical energy by the DC motor 45.

The conversion unit includes the DC motor 45. By a simple configuration of the DC motor 45, it is possible to convert the elastic energy to the electrical energy.

The fourth support shaft 60 rotates and moves the ejectors 42 and 43 based on the rotation shaft 45*b* of the DC motor 45. It is possible to efficiently convert the elastic energy stored in the winding spring 81 into the electrical energy by the DC motor 45 through the fourth support shaft 60.

In addition, the image forming system 1 according to the embodiment includes the sheet post-processing apparatus 21. In the image forming system 1, it is possible to efficiently use the elastic energy stored in the winding spring 81 without waste.

In the embodiment, the drive motor 57 is driven by using the electrical energy stored in the power storage unit 94. However, application of the electrical energy stored in the power storage unit 94 is not limited to the drive motor 57. That is, the electrical energy stored in the power storage unit 94 may be used in the aligning plate movement mechanism for driving the pair of lateral alignment plates 47. When the sheet discharging tray unit 24 or the like includes a light emitting diode (LED), the electrical energy stored in the power storage unit 94 may be also used to power the LED.

When the electrical energy stored in the DC motor 45 is used in the application of small power consumption such as LED and the like, the sheet post-processing apparatus 21 may not include the power storage unit 94, the electrical power detection unit 95, and the power storage control unit 100. In this case, LED or the like may be used without storing the electrical energy converted in each returning process S3 of the ejector.

The detection unit is the electrical power detection unit 95 that detects the electrical power of the electrical energy stored in the power storage unit 94. However, the detection unit may also detect a potential difference or the like between both electrodes of the power storage unit 94. A power storage control unit determines whether or not the electrical energy is supplied to the drive unit 44 or the like, based on whether or not the detected potential difference is equal to or greater than a predetermined reference potential difference.

The sheet post-processing apparatus 21 includes two ejectors 42 and 43. However, the number of the ejectors included in the sheet post-processing apparatus 21 is not particularly limited thereto, may be also one, and may be also three or more.

According to at least one of embodiments described above, by implementing the DC motor 45, it is possible to efficiently use the elastic energy stored in the winding spring 81 without waste.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a first holding unit configured to hold one or more sheets and movable in a sheet transport direction;

a drive unit configured to move the first holding unit in the sheet transport direction;

a biasing member that biases the first holding unit in a second direction opposite to the sheet transport direction, stores elastic energy when the first holding unit is moved in the sheet transport direction, and moves the first holding unit in the second direction when the stored elastic energy in the biasing member is released; and a conversion unit having a shaft configured to be rotated by the elastic energy stored in the biasing member to generate electrical energy.

2. The apparatus according to claim 1, further comprising:

a power storage unit that stores the electrical energy generated by the conversion unit.

3. The apparatus according to claim 2, wherein the drive unit is further configured to move the first holding unit using, at least in part, the electrical energy stored in the power storage unit.

4. The apparatus according to claim 3, further comprising:

a detection unit configured to detect electrical power of the electrical energy stored in the power storage unit; and a power storage control unit configured to control the power storage unit based on a detection result of the detection unit, wherein the power storage control unit supplies the electrical energy stored in the power storage unit to the drive unit when the electrical power detected by the detection unit is equal to or greater than a predetermined power, and does not supply the electrical energy stored in the power storage unit to the drive unit when the electrical power detected by the detection unit is less than the predetermined reference electrical power.

5. The apparatus according to claim 1, further comprising:

a first switching unit configured to move between an engaged state in which the drive unit is operably engaged with the first holding unit and a released state in which the drive unit is not operably engaged with the first holding unit.

6. The apparatus according to claim 5, further comprising:

a switching control unit configured to control the first switching unit, wherein the switching control unit switches the first switching unit from the engaged state to the released state if the first holding unit is moved in the sheet transport direction to a reference position.

7. The apparatus according to claim 5, further comprising:

a second switching unit that causes the first holding unit and the conversion unit to be operably engaged with each other when the first holding unit is moved in the second direction, and causes the first holding unit and the conversion unit to not be engaged when the first holding unit is moved in the sheet transport direction.

8. The apparatus according to claim 1, wherein the shaft in the conversion unit is included in a DC motor that generates the electrical energy.

9. The apparatus according to claim 8, wherein the drive unit includes a supporting shaft, the first holding unit moves in response to rotation of the supporting shaft, and the shaft of the DC motor rotates in response to rotation of the supporting shaft when the accumulated elastic energy in the biasing member is released.

10. A method of operating a sheet post-processing apparatus comprising the steps of:

holding one or more sheets with a first holding unit;

moving the first holding unit with the sheets held therein in a sheet transport direction;

when the first holding unit is moved in the sheet transport direction, sorting elastic energy in a biasing member that biases the first holding unit in a second direction opposite to the sheet transport direction; and rotating a shaft with the accumulated elastic energy to generate electrical energy.

11. The method according to claim 10, further comprising the step of:

moving the first holding unit in the second direction using the stored elastic energy.

12. The method according to claim 10, further comprising the step of:

storing the electrical energy converted from the potential energy in a power storage unit.

13. The method according to claim 12, wherein the first holding unit is moved in the sheet transport direction using, at least in part, the electrical energy stored in the power storage unit.

14. The method according to claim 13, further comprising the steps of:

detecting electrical power of the electrical energy stored in the power storage unit; and controlling the power storage unit based on the detected electrical power so that:

the electrical energy stored in the power storage unit is used to move the first holding unit when the detected electrical power is equal to or greater than a predetermined power, and the electrical energy stored in the power storage unit is not used to move the first holding unit when the detected electrical power is less than the predetermined reference electrical power.

15. The method according to claim 10, further comprising the step of:

moving a first switching unit from an engaged state in which a drive unit is operably engaged with the first holding unit and a released state in which the drive unit is not operably engaged with the first holding unit.

16. The method according to claim 15, wherein:

the first switching unit is moved from the engaged state to the released state when the first holding unit is moved in the sheet transport direction to a reference position.

17. The method according to claim 16, wherein:

a second switching unit causes the first holding unit and the conversion unit to be operably engaged with each other when the first holding unit is moved in the second direction, and the first holding unit and the conversion unit are not engaged when the first holding unit is moved in the sheet transport direction.

18. The method according to claim 10, wherein the elastic energy stored in the biasing member is converted in a conversion unit that includes a DC motor having the shaft that rotates by the stored elastic energy.

19. An image forming system comprising:

an image forming apparatus configured to form an image on a sheet; and a sheet processing apparatus configured to perform processing on one or more sheets conveyed from the image forming apparatus, the sheet processing apparatus including at least:

a first holding unit configured to hold one or more sheets and movable in a sheet transport direction, a drive unit configured to move the first holding unit in the sheet transport direction, a biasing member that biases the first holding unit in a second direction opposite to the sheet transport direction, stores elastic energy when the first holding unit is moved in the sheet transport direction, and moves the first holding unit in the second direction when the stored elastic energy in the biasing member is released, and a conversion unit having a shaft configured to be rotated by the elastic energy stored in the biasing member to generate electrical energy.

20. The image forming system according to claim 19, wherein the converted electrical energy is used, at least in part, to power at least one component of the image forming system.

* * * * *